United States Patent [19]

Vernam et al.

[11] 4,409,036

[45] Oct. 11, 1983

[54] ALUMINUM ALLOY SHEET PRODUCT SUITABLE FOR HEAT EXCHANGER FINS AND METHOD

[75] Inventors: William D. Vernam; Ralph W. Rogers, Jr.; Harry C. Stumpf, all of New Kensington, Pa.

[73] Assignee: Aluminum Company of America, Pittsburgh, Pa.

[21] Appl. No.: 219,574

[22] Filed: Dec. 23, 1980

[51] Int. Cl.[3] ..... C22F 1/04; C22C 21/04

[52] U.S. Cl. ..... 148/2; 148/11.5 A; 148/12.7 A; 148/415; 148/416; 148/437; 148/438

[58] Field of Search ..... 148/2, 11.5 A, 32, 32.5, 148/12.7 A; 75/146, 148, 141, 143

[56] References Cited

U.S. PATENT DOCUMENTS

| | | | |
|---|---|---|---|
| 3,843,333 | 10/1974 | Woods | 29/191 |
| 3,926,690 | 12/1975 | Morris et al. | 143/32 |
| 4,002,502 | 1/1977 | Bainbridge et al. | 148/3 |
| 4,068,645 | 1/1978 | Jenkinson | 123/193 |
| 4,077,810 | 3/1978 | Ohuchi et al. | 148/2 |
| 4,126,448 | 11/1978 | Moore et al. | 75/146 |

FOREIGN PATENT DOCUMENTS

| | | | |
|---|---|---|---|
| 829816 | 12/1969 | Canada | 53/246 |

*Primary Examiner*—R. Dean

*Attorney, Agent, or Firm*—Andrew Alexander

[57] ABSTRACT

A wrought aluminum alloy sheet product suitable for forming into heat exchanger fins is disclosed. The sheet product contains essentially 2 to 13 wt. % Si, 4 max, wt. % Zn, 0.005 to 0.5 wt. % Sr, up to 1 wt. % each of Fe and Cu, the balance essentially aluminum and incidental impurities. The sheet product is characterized by a substantially uniform distribution of relatively fine generally equiaxed constituents comprised mainly of elemental silicon.

43 Claims, 10 Drawing Figures

ALUMINUM ALLOY SHEET PRODUCT SUITABLE FOR HEAT EXCHANGER FINS AND METHOD

INTRODUCTION

This invention relates to an aluminum alloy, and more particularly, it relates to a wrought aluminum alloy sheet or foil product suitable for forming into heat exchanger fins of the type having integral extending collars.

In aluminum sheet used for fin stock, it is common practice to form integral extending collars on the sheet. It is desirable for aluminum sheet on which the integral extending collars are formed to have relatively high yield strengths so that the unformed fins as well as the collars formed from such material will not be readily damaged by accidental contact. In addition, it is important that the fins when formed into a heat exchanger be resistant to damage. Yet, it is important that the sheet material have a high level of formability in order to form the collars. That is, in certain heat exchanger applications, such as air conditioners or baseboard heaters or the like, it is desirable to have relatively high collars in order to have a substantial space between fins. In the past, this was achieved by using sheet having low yield strength and high ductility. However, this resulted in having to use relatively thick fins in order to make fins resistant to damage. However, the use of thicker fins results in greater weight and cost for a heat exchanger assembly. Also, when it was attempted to form high collars on higher strength material with lower ductility, the collars would normally fracture or break, resulting in a less effective and weakened heat exchanger assembly. When only shallow collars can be formed, this greatly increases the number of fins and, consequently, increases the amount, weight and cost of sheet required for a heat exchanger. It can be seen that in automobiles, for example, where it is desirable to keep cost and weight as low as possible, it is advantageous to have a sheet product which has high resistance to damage, and yet has a high level of ductility in order to form deep collars which permit greater spacing of fins in the heat exchanger.

The present invention solves the problems encountered in prior art materials and provides a structural sheet product suitable for forming into fin stock in which deep integral collars can be formed without fracturing. That is, the structural sheet product of the present invention has a high yield strength which increases the sheet's resistance to damage in the assembled or unassembled condition. Further, the sheet product has a high level of ductility or formability which permits forming of deep collars. Further, these unique features permit the use of fin stock of thinner gauge (typically about 20% thinner) than would be conventionally used in heat exchanger assemblies because of the advantage of increased or greater resistance to damage. It will be appreciated that the 20% savings in gauge thickness without any sacrifice in strength is, in itself, a marked advance. Further, it will be appreciated that obtaining these qualities, in addition to being able to form deep integral collars, results in a remarkably unique aluminum base alloy sheet product.

OBJECTS

A principal object of this invention is to provide a wrought aluminum base alloy sheet or foil product.

Another object of this invention is to provide a wrought aluminum base alloy structural sheet product suitable for use in heat exchanger fins.

Yet another object of this invention is to provide a wrought aluminum base alloy sheet product suitable for use in heat exchanger fins, the fins characterized by having increased resistance to damage.

A further object of this invention is to provide a wrought aluminum base alloy sheet product suitable for use in heat exchanger fins characterized by increased yield strength and yet retaining a high level of formability for purposes of forming deep integral collars on said fins.

And yet, a further object of this invention is to provide a heat exchanger assembly utilizing fins formed from a wrought aluminum base alloy sheet product having increased yield strength and yet retaiing high levels of formability for forming deep integral collars on said sheet for purposes of providing fins in said assembly with increased spaced relationship.

These and other objects will become apparent from the specification, drawings and claims appended hereto.

SUMMARY OF THE INVENTION

In accordance with these objects, there is provided a wrought aluminum alloy sheet product suitable for forming into heat exchanger fins. The sheet product has its primary thickness comprised of alloy containing essentially 2 to 13 wt.% Si, 4 max. wt.% Zn, 0.005 to 2 wt.% Sr and up to 1 wt.% each of Fe and Cu, the balance essentially aluminum and incidental impurities. The sheet is characterized by a substantially unifom distribution of relatively fine generally equiaxed constituents comprised mainly of elemental silicon.

DETAILED DESCRIPTION OF THE PREFERRED EMBODIMENTS

Figure 1:
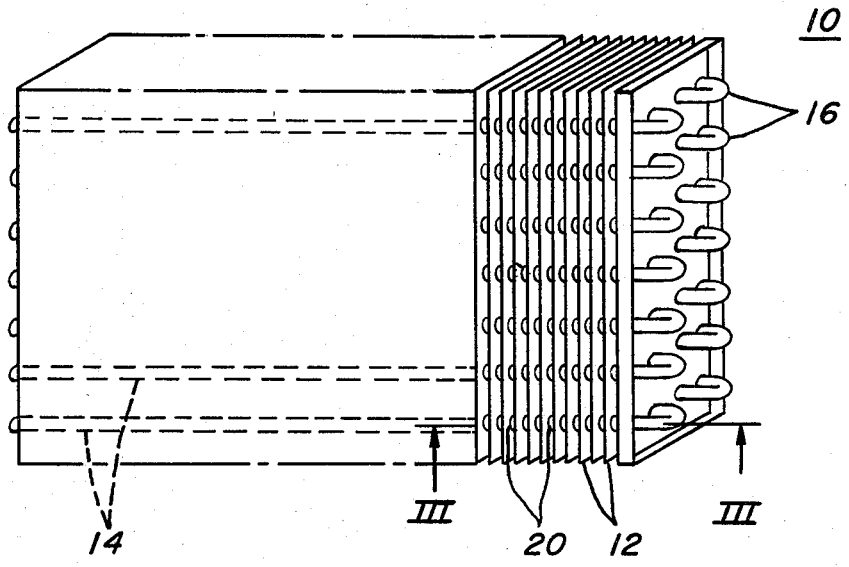
FIG. 1 is a perspective view of a heat exchanger assembly showing fins which can be fabricated from aluminum base alloy sheet stock in accordance with the invention.

Referring now to FIG. 1, there is illustrated a coil or core, referred to generally as 10, comprised of a stack of fins 12 (only about one-third of the fins shown) held together with tubes 14 (see FIG. 3) with return tubes 16 shown on one end of the coil. The coil may be attached to headers and takeoff and return pipes, none of which are shown. It will be noted that the fins are uniformly spaced with respect to each other on tubes 14, the spacing being provided by use of collars 20 as may be best seen in FIG. 3. From FIG. 1 it can be seen that spacing is important in order to minimize the number of fins in a coil. Further, it can be seen that yield strength is important in order to increase the resistance of the fins to damage. Ductility of the material from which the fins are made is important in order to provide for well-spaced fins.

Figure 2:
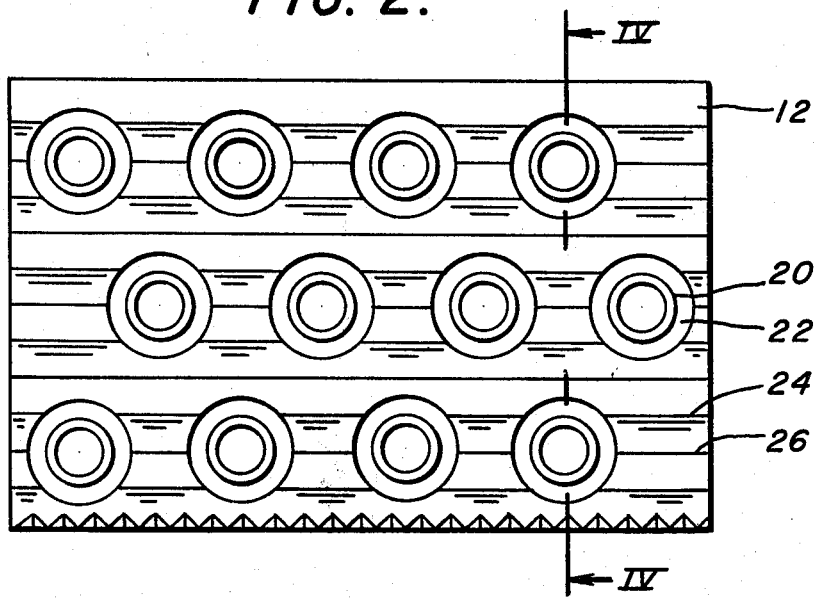
FIG. 2 is a plan view of a heat exchanger fin which has been formed for mounting in a heat exchanger assembly.
Figure 3:
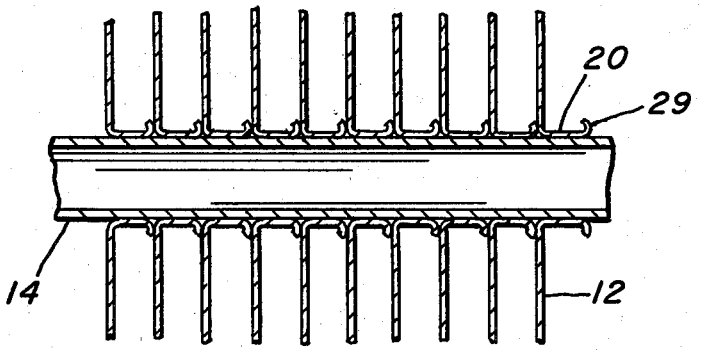
FIG. 3 is a cross-sectional view along the line III—III of FIG. 1 showing fins stacked on a heat exchanger tube.
Figure 5:
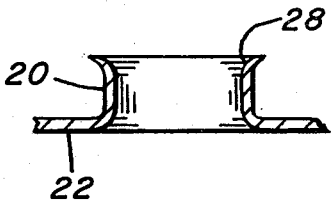
FIG. 5 is a cross-sectional view along the line V—V of FIG. 4.
Figure 4:
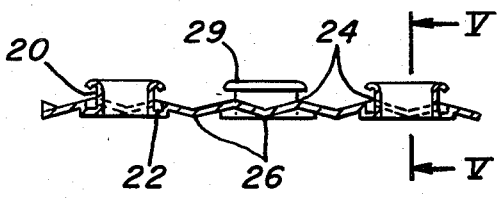
FIG. 4 is a cross-sectional view along the line IV—IV of FIG. 2.

With respect to forming, FIG. 2 shows a plan view of a typical fin prior to being assembled on tubes, such as shown in FIG. 3. The fin shown in FIG. 2 is provided with integrally formed collars 20 surrounded by a circular flat ring portion 22. In the embodiment shown in FIGS. 2 and 4, the fin has a hill 24 and valley 26 or washboard or corrugated configuration with the collars being formed or centered in the valleys 26. In some forming procedures, the collars may be provided with a flared portion 28 at the top thereof as in FIG. 5. In others, the top portion may be formed to provide a curl 29 as shown in FIGS. 3 and 5.

Usually, sheet material to be used for fin stock is rolled to a thickness in the range of about 0.006 to 0.0035 inch with the thinner gauges being preferred. However, as explained earlier, the thickness is usually limited in one respect by the yield strength of the metal or its ability to withstand damage. The sheet material of the present invention is advantageous in this respect in that it can be used in a sheet thickness of typically about 0.0045 to 0.0035 inch, whereas aluminum alloys conventionally used for fin stock typically require a thickness of about 0.0055 inch with attempts being made to reduce this level to 0.0045 inch. However, where conventional alloys, such as aluminum alloys 1100 and 7072 in the 0 temper, are used in 0.0045-inch gauge, only very shallow collars can be obtained, and as noted earlier, this increases the number of fins per inch and, in reality, seems to offset any advantage gained. The sheet stock of the present invention can be used in the 0.0045 to 0.0035-inch gauge without sacrificing collar height or even yield strength.

When a wrought aluminum sheet product, in accordance with the invention, is desired, the alloy should consist essentially of, by weight, 2 to 13% Si, max. 4% Zn, 0.005 to 0.5% Sr, max. 1% Fe, max. 1% Cu, max. 0.25% Mn, max. 0.10% Mg, with the sum total of other impurities not greater than 0.15%, the balance essentially aluminum. By max. 4% Zn it is meant to include 0 to 4% Zn. A Zn addition is preferred when the application is fin stock. By adding Zn, the solution potential of the fins is increased. In this way, the heat exchanger's resistance to corrosion is increased because the fins act as sacrificial anodes. Preferably, the amount of Zn is not greater than 1.5% when the amount of Cu is maintained to a level of not greater than 0.30%. However, it should be understood that as the amount of Cu is increased, it is important to increase the amount of Zn for purposes of maintaining resistance to corrosion. If it were desired to increase the strength of the sheet product by adding Cu, for example, solution potential of the alloy may be detrimentally affected with respect to corrosion resistance, particularly where the sheet is to be used for fin stock. Thus, to change the solution potential so as to increase the heat exchanger's resistance to corrosion, it may be necessary to add a certain amount of Zn. For example, if it is desired to add 0.6 wt.% Cu, then about 2.5 wt.% Zn should be added for purposes of increasing the corrosion resistance. It will be appreciated that in certain applications in which the sheet product may be used, it may be desirable to minimize the amount of zinc present. For example, where the sheet is rolled to a gauge, e.g. 0.001 to 0.003 inch, suitable for packaging food products in semi-rigid containers or trays such as dinner trays, then the amount of zinc should be as low as possible and should be less than 0.2 wt.% and preferably less than 0.1 wt.%. However, where zinc is not required to be minimized, as for example where the intended use is fin stock, then it should be greater than 0.2 wt.% and preferably greater than 0.3 wt.%.

With respect to copper, it can be added in increased amounts up to 1 wt.%, but as already noted, particularly if the application is fin stock, then it may be desirable to add increased amounts of zinc. For most applications, however, it is preferred that copper be kept to 0.3 wt.% or less.

It should be understood that the sheet material to be used as heat exchanger fin stock in accordance with the invention is joined by expanding the tube diametrically to provide an interference fit with the fin collar in order to provide a heat path from the tube to the fin. That is, fins and tubes are not joined by vacuum or dip brazing processes since the alloy has a relatively low melting point.

Strontium, which should be considered to be a character-forming element, is also an important component in the alloy of the present invention. Strontium must not be less than 0.005 wt.% and preferably is maintained in the range of 0.005 wt.% to 0.5 wt.% with additional amounts not presently believed to affect the performance of the product adversely, except that increased amounts may not be desirable from an economic standpoint. For most applications, strontium is preferably present in the range of 0.01 wt.% to 0.25 wt.%, with typical amounts being in the range of 0.01 wt.% to 0.10 wt.%.

The addition of strontium to the composition has the effect of refining silicon particles. It is not clearly known how this effect comes about. One theory is that the Sr is believed to effect growth of Si crystals. It is believed that interfacial energy between Si crystals and melt is changed so that growth of Si is inhibited during ingot solidification, and the crystals formed have a generally rounded shape. In addition, to maintain this advantage the alloy must be fabricated in accordance with specific method steps so as to retain the fine particles in the wrought product and the resulting special properties.

The addition of strontium is believed to have the effect of promoting fine grain size with respect to aluminum, particularly in the presence of silicon. The strontium first refines the silicon particles which in turn are believed to determine or define the grain boundaries for aluminum. Accordingly, it is believed that fine particles of silicon promote fine grains of aluminum which further aid or enhance the formability characteristics.

Figure 6:
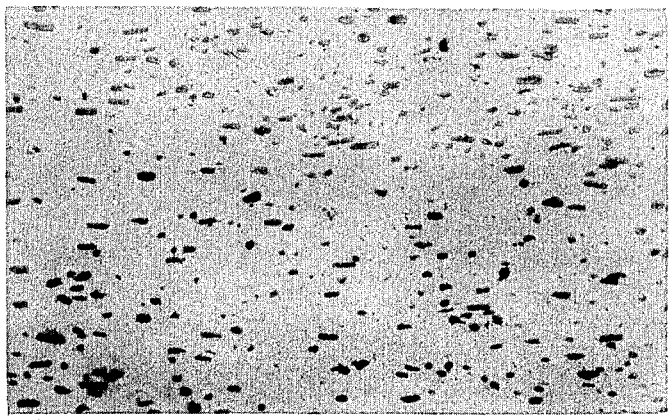
FIG. 6 is a photomicrograph at 500× of an aluminum base alloy sheet product containing about 5½ wt.% silicon.
Figure 7:
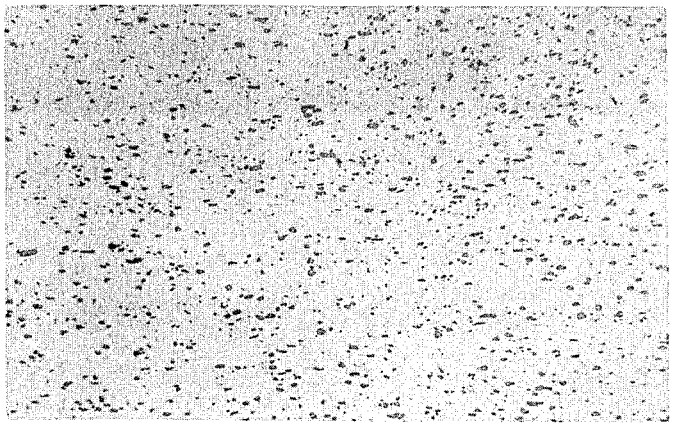
FIG. 7 is a photomicrograph at 500× of an aluminum base alloy sheet product with refined silicon particle size in accordance with the invention.

The benefit of adding strontium can be seen by comparing the micrographs of FIGS. 6 and 7. In FIG. 6 there is shown a micrograph (500×) of a sheet product containing essentially 5.55 wt.% Si, 0.24 wt.% Fe, about 0.01 wt.% Mn and 0.01 wt.% Zn, which was cast by the direct chill method and rolled into a sheet product. An ingot having this composition was first hot rolled at a temperature of 875° F. to a thickness of about 0.125 inch and then given an anneal at 650° F. for 2 hours, after which it was cold rolled to a thickness of about 0.0045 inch. From an examination of FIG. 6, it will be seen that silicon particles are relatively large and are generally rod-shaped. FIG. 7 is a micrograph (500×) of an alloy having the same composition as that shown in FIG. 6 except 0.02 wt.% strontium was added. The alloy was rolled in the same way as for the alloy of FIG. 6. It will be seen that the silicion particles are greatly reduced in size when compared to FIG. 6. Also, the particles have a substantially uniform distribution and are generally equiaxed in shape. Thus, it will be observed that the strontium has the effect of refining the silicon particle.

Figure 8:
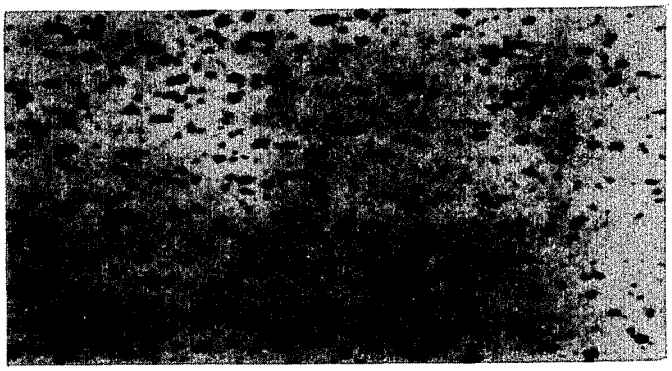
FIG. 8 is a photomicrograph at 500× of an aluminum base alloy sheet product containing about 12 wt.% silicon.
Figure 9:
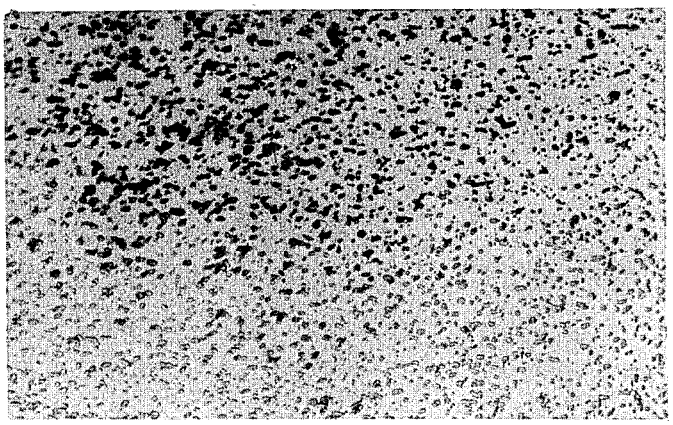
FIG. 9 is a photomicrograph at 500× of an aluminum base alloy sheet product with refined silicon particle size in accordance with the invention.

Even with higher concentrations of silicon, the same effect is obtained. For example, FIG. 8 is a micrograph (500×) of an aluminum base alloy containing 12.2 wt.% Si, 0.25 wt.% Fe and 0.02 wt.% Mn. This material was cast and rolled as noted above. It can be seen that relatively large, rod-shaped silicon particles are distributed throughout the matrix. FIG. 9 shows a similar composition to that of FIG. 8 except 0.02 wt.% strontium and 1.02 wt.% zinc were added and the alloy was cast and fabricated in the same manner. Again, it will be noted that the micrograph shows a substantially uniform distribution of relatively fine generally equiaxed constituents comprised mainly of elemental silicon. Thus, from these micrographs it will be seen that strontium has the effect of refining silicon particles in the alloy and maintaining the refined condition even after the alloy has been fabricated into a wrought sheet product, for example.

As well as providing the wrought product in an alloy having controlled amounts of alloying elements as described above, it is preferred that the alloy be prepared and fabricated into products according to specific method steps in order to provide the most desirable characteristics. Thus, the alloy described herein can be provided as an ingot or billet for fabrication into a suitable wrought product by techniques currently employed in the art, with continuous direct chill casting being preferred. The cast ingot may be preliminarily worked or shaped to provide suitable stock for subsequent working operations. Typically, it can be rolled to produce sheet suitable for shaping into the end product. To produce a sheet-type product, a body of the alloy is preferably hot rolled to a thickness ranging from about 0.038 to 0.14 inch and typically around 0.125 inch. For hot rolling purposes, the temperature should be typically in the range of 900° F. down to about 500° F. Preferably, the metal temperature initially is in the range of 825° F. to 890° F. When the intended use of the sheet is for fin stock applications, normally additional operations include cold rolling where the sheet is rolled down to a thickness of about 0.0030 to 0.0065 inch, with a typical thickness being in the range of about 0.0035 to 0.0055 inch. In certain instances, after the ingot has been hot rolled to sheet gauge (less than 0.250 inch), for example 0.125 inch, it may be preferred to subject the sheet to an annealing process prior to cold rolling. This, of course, can depend, for example, on whether edge cracking has been encountered. For purposes of annealing, the sheet product can be subjected to a temperature in the range of 500° F. to 850° F. for a period of time in the range of ½ to 5 hours, with a typical annealing temperature being in the range of 600° F. to 700° F. for a period of about 1 to 3 hours. As a general guide, the annealing should be carried out at a temperature and time which will substantially recrystallize the microstructure. It should be noted that for purposes of hot rolling that a preheat or homogenization treatment is not necessary and, in fact, such treatments are considered detrimental for purposes of producing a sheet product in accordance with the invention. Accordingly, extended times at temperatures at which hot rolling is initiated should be avoided because extended periods at these temperatures can permit the silicon particles to agglomerate, detrimentally affecting the properties and ductility of the product. Thus, it can be seen that it is important that the sheet product be prepared in accordance with rather specific steps in order to achieve strengths and levels of formability required for fin stock.

Figure 10:
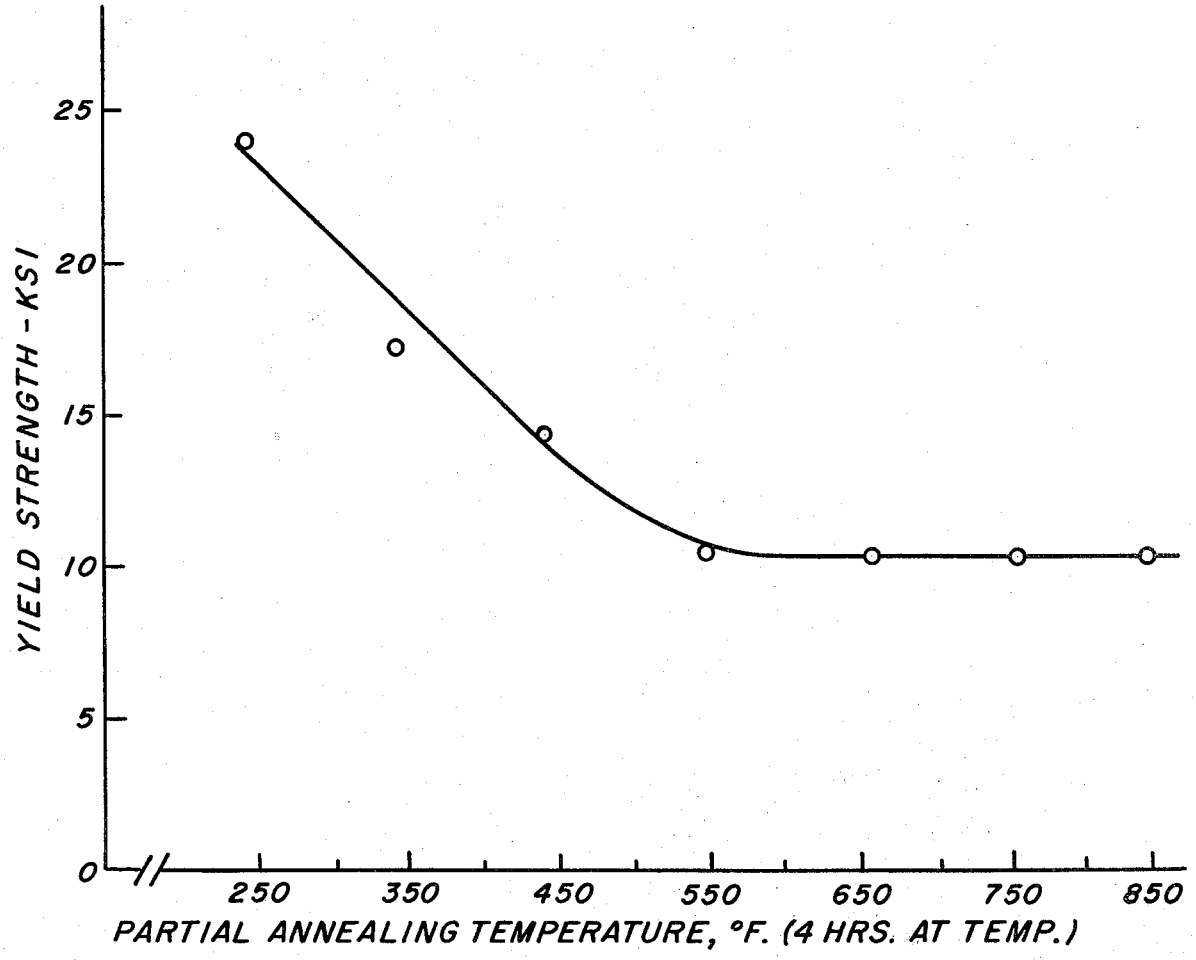
FIG. 10 is a plot of yield strength versus temperature for the alloy of the present invention.

Prior to forming the sheet into wrought products such as fins having integral collars thereon, as described hereinabove, it may be necessary to subject it to an additional partial anneal to provide or improve properties, including the desired strength and formability necessary to the final product and to the operation of forming that product. Thus, preferably, the sheet product is subjected to a partial anneal at a temperature in the range of 350° F. to 550° F. for a time period in the range of ½ hour to 6 hours with a typical partial anneal being at 450° F. for about 4 hours. Another advantage of the invention is the response of the sheet product of the invention to partial annealing. That is, conventional alloys, such as Aluminum Association Alloy 1100, are much more sensitive to annealing temperatures. This point is illustrated in FIG. 10 where there is shown a plot of yield strength of the sheet product versus temperature for 1100 and the alloy of the present invention. It will be noted that to optimize the properties of 1100 by partial annealing, the temperature control is very critical in order to avoid over-annealing and resultant adverse effects on properties. This is an important feature, and in 1100 there is only a very small margin for error. In comparison, the alloy of the wrought sheet product of the invention is relatively insensitive in this respect, as can be seen from the plot of FIG. 10, and accordingly provides for much greater ease of fabrication. This is a very important feature since it greatly increases the efficiency of the fabricating process by greatly minimizing the amount of sheet product that might have to be scrapped because of over-annealing.

As noted earlier, the partial annealing is important from the standpoint of achieving the properties of the sheet. Further, it will be understood that the properties obtainable from the wrought sheet product of the present invention are unique when compared to conventional alloys and sheet fabricated therefrom used for fin stock applications. A comparison of properties of conventional fin stock materials and the alloy of the present invention containing about 12.5 wt.% Si is provided in Table I below.

TABLE I

| Alloy/ Temper | Tensile Strength-ksi Ultimate Min. | Ultimate Max. | Yield Min. | Elongation in 2" % Min. | Olsen in Stock | Sheet Thickness |
|---|---|---|---|---|---|---|
| Alloy of Fig. 9 -H19 | 17.0 | 25.0 | 11.0 | 20 | 0.330 (value corrected for thickness - 0.345) | 0.0045 |
| 7072-0 | 8.0 | 13.0 | 3.0 | 15 | 0.342 | 0.0055 |
| 7072-H113 | 8.0 | 14.0 | 4.0 | 15 | 0.332 | 0.0055 |
| 1100-0 | 11.0 | 15.5 | 3.5 | 15 | 0.354 | 0.0055 |
| 1100-H113 | 11.0 | 16.0 | 5.0 | 15 | 0.332 | 0.0055 |
| 3003-0 | 14.0 | 19.0 | 5.0 | 14 | — | — |
| 3003-H113 | 14.0 | 20.0 | 6.5 | 14 | — | — |

From Table I it can be seen that the minimum and maximum tensile strengths exceed the strengths of the conventional alloys listed. With respect to minimum yield strength, the alloy of the present invention has doubled and tripled these strengths in all but one case. Yield strength is important in that it gives an indication of the fin's resistance to damage. In addition, the sheet product of the invention has an elongation value which is much greater than those for conventional alloys. Also, the tensile and yield strengths have been obtained at no sacrifice to formability. The Olsen value of 0.330 for the alloy of the subject invention was obtained on a sheet thickness of 0.0045 inch and the Olsen value for conventional alloys was obtained on a sheet thickness of 0.0055. Since thinner gauges lower than Olsen value, a corrected Olsen value of 0.345 for the sheet material of this invention is provided which cares for the difference in thickness. The Olsen value, coupled with the elongation value, clearly demonstrate that the alloy of the present invention has a very high level of formability which is surprising in view of the rather high tensile properties when compared to conventional alloys. Olsen cup values referred to herein are measured according to procedures outlined in a publication entitled "Comparison of Olsen Cup Values on Aluminum Alloys", first edition, published by The Aluminum Association, February 1975. The lubricant used in measurements is a combination of Quaker Draw 289 Oil and lab #4 polyethylene.

Reference has been made herein mainly to a sheet product. However, the thicknesses referred to for fin stock are in a gauge thickness conventionally referred to in the art as foil. Thus, the word "sheet" is used herein in its broader sense and contemplates within its purview plate, sheet and foil.

The alloy of the present invention has been found to provide relatively high levels of tensile and formability properties even when the silicon content is quite low. The following Table II tabulates the tensile and formability properties for alloys of the invention containing about 5.5 wt.% silicon. It will be noted that properties are provided for partial anneal at 350° F. and for 450° F.

TABLE II

| Alloy -H19 Temper | 4 HRS./350° F. TS, ksi | YS, ksi | % El. (2") | Olsen - Sheet 0.0055" thick (In.) |
|---|---|---|---|---|
| Alloy of Fig. 6 | 20 | 16 | 20 | .287 |
| Alloy of Fig. 6 + .02 Sr | 19 | 16 | 27 | .287 |

TABLE II-continued

| Alloy -H19 Temper | TS, ksi | YS, ksi | % El. (In.) | Olsen - Sheet 0.0055" thick (In.) |
|---|---|---|---|---|
| Alloy of Fig. 6 + .02 Sr + 1 Zn + .2 Cu | 24 | 22 | 20 | .282 |
| Alloy of Fig. 8 + .02 Sr + 1 Zn | 23 | 17 | 28 | .342 |
| | 4 HRS./450° F. | | | |
| Alloy of Fig. 6 | 16 | 7 | 36 | .353 |
| Alloy of Fig. 6 + .02 Sr | 17 | 8 | 32 | .353 |
| Alloy of Fig. 6 + .02 Sr + 1 Zn + .2 Cu | 22 | 12 | 28 | .344 |
| Alloy of Fig. 8 + .02 Sr + 1 Zn | 23 | 14 | 30 | .329 |

A preferred heat treating temperature range is 177° C. to 232° C. and a preferred time is in the range of 1 to 2 hours. The cold rolling step is normally extended to achieve an H19 temper condition. However, sheet product can be used in certain instances in the 0-temper (fully annealed condition) or in the F-temper (as-rolled condition). It will be noted that precipitation of silicon by a partial anneal at an intermediate stage in cold rolling by this method is important in that it contributes significantly to the formability levels obtainable by the present alloy while maintaining rather significant increases in tensile properties when compared to conventional alloys. Further, such results from the heat treating and rolling steps are surprising since grain boundary precipitation normally leads to embrittlement instead of the high levels of formability which characterize the wrought sheet product of the present invention.

After cold rolling to a final H19 temper, it may be desirable to subject the sheet to an additional partial anneal to provide or improve properties. The partial anneal to improve properties may be carried out substantially as noted earlier.

In another aspect of the invention, it has been discovered that the formability of the sheet or foil product may be improved by specific method steps. That is, it has been discovered that improved formability may be obtained by grain boundary or thermal precipitation treatments combined with cold rolling treatments. For example, in the controlled method steps referred to earlier, it was noted that the alloy was not rolled down to about 0.125 inch gauge at which point it was preferred to subject the sheet to an anneal and thereafter to cold roll it down to the final gauge. It is after this first anneal that it has been found that this aspect of the invention can be important. For instance, this first anneal results in what may be referred to as a supersaturated solution. If the annealed sheet is rolled to a smaller gauge, for example 0.038 inch, and is then subjected to a heat treating step at a temperature in the range of 120° C. to 232° C. for a time period in the range of ½ hour to 4 hours, silicon particles will be precipitated at the grain boundaries. The heat treating step is important in that the temperature must be controlled within the ranges indicated in order to cause precipitation at the grain boundaries without sufficient precipitation to essentially eliminate the supersaturation. Thereafter, the sheet has to be cold rolled to the final gauge. The cold rolling step is important in that it serves to break up the association of grain boundaries with silicon particles.

From Table II it can be seen that high levels of formability can be obtained, particularly when the partial anneal temperature of 450° F. was used for the final gauge sheet.

While the invention has been described in terms of preferred embodiments, the claims appended hereto are intended to encompass other embodiments which fall within the spirit of the invention.

What is claimed is:

1. Heat exchanger fin stock consisting essentially of 2 to 13 wt.% Si, 4 max. wt.% Zn, 0.005 to 2 wt.% Sr, up to 1 wt.% each of Fe and Cu, the balance essentially aluminum and incidental impurities, the fin stock characterized by a substantially uniform distribution of relatively fine, generally equiaxed constituents comprised mainly of elemental silicon.

2. The fin stock in accordance with claim 1 wherein the amount of Cu is not greater than 0.3 wt.%.

3. The fin stock in accordance with claim 1 wherein the amount of Zn is not greater than 1.5 wt.%.

4. The fin stock in accordance with claim 1 wherein the amount of Zn present is not less than 0.3 wt.%.

5. The fin stock in accordance with claim 1 wherein the amount of strontium is in the range of 0.005 to 0.5 wt.%.

6. The fin stock in accordance with claim 1 wherein the amount of strontium is in the range of 0.01 to 0.25 wt.%.

7. The fin stock in accordance with claim 1 wherein the amount of Fe is not greater than 0.5 wt.%.

8. Heat exchanger fin stock consisting essentially of 2 to 12.5 wt.% Si, 0 to 4 wt.% Zn, 0.005 to 0.5 wt.% Sr, up to 0.5 wt.% Fe, the balance essentially aluminum and incidental impurities, the fin stock characterized by a substantially uniform distribution of relatively fine, generally equiaxed constituents comprised mainly of elemental silicon.

9. A method of producing a wrought aluminum sheet product for fin stock characterized by a substantially uniform distribution of relatively fine, generally equiaxed constituents comprised mainly of elemental silicon, comprising the steps of:

(a) providing a body of aluminum base alloy consisting essentially of 2 to 13 wt.% si, 0 to 4 wt.% Zn, 0.005 to 2 wt.% Sr, up to 1 wt.% Fe and up to 1 wt.% Cu, the balance essentially aluminum and incidental impurities, (b) rolling said body at temperatures not higher than 925° F. to provide a sheet product, and (c) forming said sheet into heat exchanger fins.

10. The method in accordance with claim 9 wherein said body is hot rolled at a temperature in the range of 500° F. to 900° F.

11. The method in accordance with claim 9 wherein said body is hot rolled at a temperature in the range of 825° F. to 890° F.

12. The method in accordance with claim 9 wherein after said rolling step said sheet is subjected to an annealing step at a temperature in the range of 600° F. to 700° F. for a period in the range of 1 to 3 hours.

13. The method in accordance with claim 12 wherein after said annealing the sheet is cold rolled to a final gauge.

14. The method in accordance with claim 13 wherein said final gauge sheet is subjected to a partial annealing step to enhance strength and formability levels necessary to the final product and to forming the final product.

15. The method in accordance with claim 9 wherein said sheet product is subjected to a partial anneal at a temperature in the range of 350° F. to 550° F. for a time period in the range of ½ to 6 hours.

16. The method in accordance with claim 9 wherein said body is rolled to a thickness in the range of about 0.038 to 0.14 inch and after annealing, said sheet product is cold rolled to a gauge in the range of 0.0030 to 0.0065 inch.

17. A method of producing a wrought aluminum sheet product characterized by a substantially uniform distribution of relatively fine, generally equiaxed constituents comprised mainly of elemental silicon, comprising the steps of:

(a) providing a body of aluminum base alloy consisting essentially of 2 to 13 wt.% Si, 0 to 4 wt.% Zn, 0.005 to 2 wt.% Sr, up to 1 wt.% Fe and up to 1 wt.% Cu, the balance essentially aluminum and incidental impurities, (b) hot rolling said body at a temperature in the range of 500° F. to 925° F. to provide a sheet product, (c) annealing said sheet product at a temperature in the range of 600° F. to 700° F. for a period in the range of 1 to 3 hours, (d) after said annealing, cold rolling to provide a sheet product having a final guage in the range of 0.0030 to 0.0065 inch, and (e) subjecting said final gauge product to a controlled partial anneal at a temperature in the range of 350° F. to 550° F. for a period in the range of ½ to 6 hours to enhance strength and formability levels necessary to the final product and to forming the final product.

18. A method of producing a wrought aluminum sheet product characterized by a substantially uniform distribution of relatively fine, generally equiaxed constituents comprised mainly of elemental silicon, comprising the steps of:

(a) providing a body of aluminum base alloy consisting essentially of 2 to 13 wt.% Si, 0 to 4 wt.% Zn, 0.005 to 2 wt.% Sr, up to 1 wt.% Fe and up to 1 wt.% Cu, the balance essentially aluminum and incidental inpurities, (b) hot rolling said body at a temperature in the range of 500° F. to 900° F. to provide a sheet product, (c) annealing said sheet product at a temperature in the range of 600° F. to 700° F. for a period in the range of 1 to 3 hours, (d) after annealing, cold rolling the sheet to a gauge greater than a final gauge, (e) subjecting the sheet from step (d) to a thermal treatment to precipitate silicon particles at grain boundaries in the sheet, (f) thereafter cold rolling to provide a sheet product having a final gauge in the range of 0.0030 to 0.0065 inch, and (g) subjecting said final gauge product to a controlled partial anneal at a temperature in the range of 350° F. to 550° F. for a period in the range of ½ to 6 hours to enhance formability levels necessary to the final product and to forming the final product.

19. An aluminum base alloy wrought product suitable for forming into fin stock products for heat exchanger assemblies, the product consisting essentially of 2 to 13 wt.% Si, 0.3 wt.% to 4 wt.% Zn, 0.005 to 2 wt.% Sr, up to 1 wt.% Fe and up to 1 wt.% Cu, the balance essentially aluminum and impurities, the product, which when formed into fin stock, is characterized by a substantially uniform distribution of relatively fine, generally equiaxed constituents comprised mainly of elemental silicon.

20. The product in accordance with claim 19 wherein the amount of Cu is not greater than 0.3 wt.%.

21. The product in accordance with claim 19 wherein the amount of Zn is not greater than 1.5 wt.%.

22. The product in accordance with claim 19 wherein strontium is in the range of 0.005 to 0.5 wt.%.

23. The product in accordance with claim 19 wherein strontium is in the range of 0.01 to 0.25 wt.%.

24. In the method of producing a heat exchanger assembly having fin members wherein an aluminum alloy is formed to produce said fin member, wherein said member is provided by the steps comprising:

(a) providing a body of aluminum base alloy consisting essentially of 2 to 13 wt.% Si, 0 to 4 wt.% Zn, 0.005 to 2 wt.% Sr, up to 1 wt.% Fe and up to 1 wt.% Cu, the balance essentially aluminum and incidental impurities, (b) rolling said body at temperatures not higher than 925° F. to provide a sheet product, (c) annealing said sheet product, the sheet characterized by a substantially uniform distribution of relatively fine, generally equiaxed constituents comprised mainly of elemental silicon, and (d) forming of said sheet product into said heat exchanger fin member.

25. In the method in accordance with claim 24, wherein said body is rolled at a temperature in the range of 500° F. to 900° F.

26. In the method in accordance with claim 24, wherein said body is rolled at a temperature in the range of 825° C. to 890° F.

27. In the method in accordance with claim 24, wherein after the rolling step the sheet is subjected to an annealing step at a temperature in the range of 600° F. to 700° F. for a period in the range of 1 to 3 hours.

28. In the method in accordance with claim 24, wherein after said annealing the sheet is cold rolled to a final gauge.

29. In the method in accordance with claim 24, wherein said final gauge sheet is subjected to a partial annealing step to enhance strength and formability levels necessary to the final product and to forming the final product.

30. In the method in accordance with claim 24, wherein said sheet product is subjected to a partial anneal at a temperature in the range of 350° F. to 550° F. for a time period in the range of ½ to 6 hours.

31. In the method in accordance with claim 24, wherein said body is rolled to a thickness in the range of about 0.038 to 0.14 inch and after annealing, said sheet product is cold rolled to a gauge in the range of 0.0030 to 0.0065 inch.

32. In the method of producing a heat exchanger assembly having fin members wherein an aluminum alloy is formed to produce said fin member, wherein said member is provided by the steps comprising:

(a) providing a body of aluminum base alloy consisting essentially of 2 to 13 wt.% Si, 10 to 4 wt.% Zn, 0.005 to 2 wt.% Sr, up to 1 wt.% Fe and up to 1 wt.% Cu, the balance essentially aluminum and incidental impurities, (b) hot rolling said body at a temperature in the range of 550° F. to 900° F. to provide a sheet product, (c) annealing said sheet product at a temperature in the range of 600° F. to 700° F. for a period in the range of 1 to 3 hours, (d) after said annealing, cold rolling to provide a sheet product having a final gauge in the range of 0.0030 to 0.0065 inch, (e) subjecting said final gauge product to a controlled partial anneal at a temperature in the range of 350° F. to 550° F. for a period in the range of 1/1 to 6 hours to enhance strength and formability levels necessary to the final product, (f) forming the sheet product into fins, and (g) assembling said fins into said heat exchanger.

33. In the method of producing a heat exchanger assembly having fin members wherein an aluminum alloy is formed to produce said fin member, wherein said member is provided by the steps comprising:

(a) providing a body of aluminum base alloy consisting essentially of 2 to 13 wt.% Si, 10 to 4 wt.% Zn, 0.005 to 2 wt.% Sr, up to 1 wt.% Fe and up to 1 wt.% Cu, the balance essentially aluminum and incidental impurities, (b) hot rolling said body at a temperature in the range of 550° F. to 900° F. to provide a sheet product, (c) annealing said sheet product at a temperature in the range of 600° F. to 700° F. for a period in the range of 1 to 3 hours, (d) after annealing, rolling the sheet to a gauge greater than a final gauge, (e) subjecting the sheet from step (d) to a heat treatment to precipitate silicon particles at grain boundaries in the sheet, (f) thereafter cold rolling to provide a sheet product having a final gauge in the range of 0.0030 to 0.0065 inch, and (g) subjecting said final gauge product to a controlled partial anneal at a temperature in the range of 350° F. to 550° F. for a period in the range of 1/1 to 6 hours to enhance strength and formability levels necessary to the final product, (h) forming the sheet product into fins, and (i) assembling said fins into said heat exchanger.

34. In a heat exchanger assembly having fin members for purposes of dissipating heat the fin members comprised of an aluminum base alloy consisting essentially of 2 to 13 wt.% Si, 0 to 4 wt.% Zn, 0.005 to 2 wt.% Sr, up to 1 wt.% Fe and up to 1 wt.% Cu, the balance essentially aluminum and incidental impurities, the fin member fabricated from a rolled sheet product.

35. In the heat exchanger assembly in accordance with claim 34, wherein said body was rolled at a temperature in the range of 500° F. to 925° F.

36. In the heat exchanger assembly in accordance with claim 34, wherein said body was rolled at a temperature in the range of 825° F. to 890° F.

37. In the heat exchanger assembly in accordance with claim 34, wherein the sheet was annealed at a temperature in the range of 600° F. to 700° F. for a period in the range of 1 to 3 hours.

38. In the heat exchanger assembly in accordance with claim 34, wherein the sheet was cold rolled to a final gauge after it was annealed.

39. In the heat exchanger assembly in accordance with claim 34, wherein said final gauge sheet was provided in a partially annealed condition to enhance strength and formability levels necessary to the final product and to forming the final product.

40. In the heat exchanger assembly in accordance with claim 34, wherein said sheet product was provided in a condition resulting from a partial anneal at a temperature in the range of 350° F. to 550° F. for a time period in the range of ½ to 6 hours.

41. In the heat exchanger assembly in accordance with claim 34, wherein said sheet was provided in a thickness in the range of about 0.038 to 0.14 inch and after annealing, said sheet product was cold rolled to a gauge in the range of 0.0030 to 0.0065 inch.

42. In a heat exchanger assembly having fin members comprised of aluminum base alloy consisting essentially of 2 to 13 wt.% Si, 0 to 4 wt.% Zn, 0.005 to 2 wt.% Sr, up to 1 wt.% Fe and up to 1 wt.% Cu, the balance essentially aluminum and incidental impurities, the fin member fabricated from a sheet product rolled from a body of said alloy at a temperature in the range of 500° F. to 900° F.; annealed at a temperature in the range of 600° F. to 700° F. for a period in the range of 1 to 3 hours; cold rolled to a final gauge in the range of 0.0030 to 0.0065 inch; and thereafter subjected to a controlled partial anneal at a temperature in the range of 350° F. to 550° F. for a period in the range of ½ to 6 hours to enhance strength and formability levels necessary to the final product and to forming the final product.

43. In a heat exchanger assembly having aluminum alloy fin members formed from a body of aluminum base alloy consisting essentially of 2 to 13 wt.% Si, 0 to 4 wt.% Zn, 0.005 to 2 wt.% Sr, up to 1 wt.% Fe and up to 1 wt.% Cu, the balance essentially aluminum and incidental impurities, the fin members fabricated from a sheet product resulting from the body being rolled at a temperature in the ramge of 500° F. to 900° F., annealed at a temperature in the range of 600° F. to 700° F. for a period in the range of 1 to 3 hours, thereafter rolled to a gauge greater than a final gauge, subjected to a heat treatment to precipitate silicon particles at grain boundaries in the sheet, thereafter cold rolled to provide a product having a final gauge in the range of 0.0030 to 0.0065 inch, and subjected to a controlled partial anneal at a temperature in the range of 350° F. to 550° F. for a period in the range of ½ to 6 hours to enhance strength and formability levels necessary to the final product and to forming the final product.

* * * * *

UNITED STATES PATENT AND TRADEMARK OFFICE

CERTIFICATE OF CORRECTION

PATENT NO. : 4,409,036

DATED : October 11, 1983

INVENTOR(S) : W. D. Vernam et al

It is certified that error appears in the above-identified patent and that said Letters Patent are hereby corrected as shown below:

| | |
|---|---|
| Col. 7, line 32 | After "lower", change "than" to --the--. |
| Col. 8, line 49 | After "was", change "not" to --hot--. |
| Col. 9, Claim 9, line 44 | After "wt.%", change "si" to --Si--. |
| Col. 11, Claim 26, line 35 | After "of", change "825°C" to --825°F--. |
| Col. 11, Claim 32, line 63 | After "Si," change "10" to --0--. |
| Col. 11, Claim 32, line 68 | After "of", change "550°F" to --500°F--. |
| Col. 12, Claim 32, line 9 | After "of", change "1/1" to --1/2--. |
| Col. 12, Claim 33, line 19 | After "Si," change "10" to --0--. |

UNITED STATES PATENT AND TRADEMARK OFFICE

CERTIFICATE OF CORRECTION

PATENT NO. : 4,409,036

DATED : October 11, 1983

INVENTOR(S) : W. D. Vernam et al

It is certified that error appears in the above-identified patent and that said Letters Patent are hereby corrected as shown below:

Col. 12, Claim 33, line 24 — After "of", change "550°F" to --500°F--.

Col. 12, Claim 33, line 39 — After "of", change "1/1" to --1/2--.

Signed and Sealed this

*Seventeenth* Day of *April 1984*

[SEAL]

*Attest:*

GERALD J. MOSSINGHOFF

*Attesting Officer*

*Commissioner of Patents and Trademarks*